US010295923B2

(12) United States Patent
Tsujihiro et al.

(10) Patent No.: US 10,295,923 B2
(45) **Date of Patent: *May 21, 2019**

(54) ELECTROSTATIC LATENT IMAGE DEVELOPING TONER

(71) Applicant: KYOCERA Document Solutions Inc., Osaka (JP)

(72) Inventors: Masami Tsujihiro, Osaka (JP); Jun Hioki, Osaka (JP); Haruhiro Nishitera, Osaka (JP); Ryotaro Komada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 86 days.

This patent is subject to a terminal disclaimer.

(21) Appl. No.: 15/535,670

(22) PCT Filed: Dec. 22, 2015

(86) PCT No.: PCT/JP2015/085816

§ 371 (c)(1),
(2) Date: Jun. 13, 2017

(87) PCT Pub. No.: WO2016/104499

PCT Pub. Date: Jun. 30, 2016

(65) Prior Publication Data

US 2018/0356747 A1 Dec. 13, 2018

Related U.S. Application Data

(63) Continuation of application No. PCT/JP2015/085816, filed on Dec. 22, 2015.

(30) Foreign Application Priority Data

Dec. 25, 2014 (JP) ..... 2014-263259

(51) Int. Cl.
*G03G 9/093* (2006.01)
*G03G 9/08* (2006.01)
*G03G 9/087* (2006.01)

(52) U.S. Cl.
CPC ..... *G03G 9/09328* (2013.01); *G03G 9/08* (2013.01); *G03G 9/087* (2013.01); *G03G 9/0825* (2013.01); *G03G 9/09321* (2013.01)

(58) Field of Classification Search
CPC ..... G03G 9/09321; G03G 9/09328; G03G 9/09314

(Continued)

(56) References Cited

U.S. PATENT DOCUMENTS 5,153,093 A * 10/1992 Sacripante ..... G03G 9/09307 430/107.1
5,336,581 A 8/1994 Inaba et al.

(Continued)

FOREIGN PATENT DOCUMENTS

JP H05-061237 A 3/1993
JP H05-142847 A 6/1993

(Continued)

OTHER PUBLICATIONS

Japanese Patent Office J-Plat-Pat machine-assisted English-language translation of JP 2016-122145 (pub. Jul. 2016) (Year: 2016).*

(Continued)

*Primary Examiner* — Janis L Dote
(74) *Attorney, Agent, or Firm* — Studebaker & Brackett PC

(57) ABSTRACT

An electrostatic latent image developing toner includes toner particles each including a toner core and a shell layer covering a surface of the toner core. The shell layer contains a hydrophilic thermosetting resin and a hydrophobic ther- (Continued)

moplastic resin. The hydrophobic thermoplastic resin is exposed at surfaces of the toner particles. In a preferable configuration of the shell layer, a plurality of blocks substantially formed from the hydrophobic thermoplastic resin are connected to one another through a junction portion substantially formed from the hydrophilic thermosetting resin.

7 Claims, 6 Drawing Sheets

(58) Field of Classification Search
USPC ..... 430/110.2
See application file for complete search history.

(56) References Cited

U.S. PATENT DOCUMENTS

| | | | | |
|---|---|---|---|---|
| 5,484,677 | A | 1/1996 | Inaba | |
| 8,790,857 | B2 | 7/2014 | Itou et al. | |
| 9,523,937 | B2 * | 12/2016 | Tsujihiro | G03G 9/09321 |
| 9,651,885 | B2 * | 5/2017 | Kobayashi | G03G 9/09314 |
| 9,696,647 | B2 * | 7/2017 | Hori | G03G 9/09371 |
| 2005/0271964 | A1 | 12/2005 | Etou et al. | |
| 2013/0011775 | A1 | 1/2013 | Itou et al. | |
| 2013/0273469 | A1 * | 10/2013 | Akutagawa | G03G 9/08755 430/109.3 |

FOREIGN PATENT DOCUMENTS

| | | | | | |
|---|---|---|---|---|---|
| JP | H08-272236 | A | | 10/1996 | |
| JP | 2004-138985 | A | | 5/2004 | |
| JP | 2004-294469 | A | | 10/2004 | |
| JP | 2007-148200 | A | | 6/2007 | |
| JP | 2008-076778 | A | | 4/2008 | |
| JP | 2012-022087 | A | | 2/2012 | |
| JP | 2013-019972 | A | | 1/2013 | |
| JP | 2014-130293 | A | | 7/2014 | |
| JP | 2016122145 | A | * | 7/2016 | G03G 9/09328 |

OTHER PUBLICATIONS

International Search Report issued in PCT/JP2015/085816; dated Mar. 29, 2016.

* cited by examiner

ELECTROSTATIC LATENT IMAGE DEVELOPING TONER

TECHNICAL FIELD

The present invention relates to an electrostatic latent image developing toner and a method for producing the same.

BACKGROUND ART

A toner that can be favorably fixed even when heating of a fixing roller is kept at a minimal level is demanded in terms of energy saving and downsizing of an image forming apparatus. A toner having excellent low-temperature fixability is typically prepared using a binder resin having a low melting point or a low glass transition point or a releasing agent having a low melting point. However, a toner such as described above suffers from a problem that toner particles included in the toner tend to agglomerate when the toner is stored at high temperatures. In a situation in which toner particles agglomerate, the agglomerating toner particles tend to have a charge amount lower than that of other toner particles that are not agglomerating.

A toner including toner particles that have a core-shell structure may be used in order to improve low-temperature fixability, high-temperature stability and blocking resistance of the toner. For example, Patent Literature 1 describes a toner that includes toner particles in which surfaces of toner cores are each covered by a thin film containing a thermosetting component and in which the toner cores have a softening point of at least 40° C. and no greater than 150° C.

CITATION LIST

Patent Literature

[Patent Literature 1]
Japanese Patent Application Laid-Open Publication No. 2004-138985

SUMMARY OF INVENTION

Technical Problem

However, the toner described in Patent Literature 1 is produced by using a hydrophilic thermosetting resin such as a melamine resin. The hydrophilic thermosetting resin tends to absorb water molecules in an environment of high temperature and high humidity. Therefore, electrical conductivity of a surface of the toner tends to increase and a charge amount of the toner tends to decrease. A decrease in the charge amount of the toner tends to result in a decrease in transfer efficiency of the toner.

The present invention was made in view of the above-described problem, and it is an object of the present invention to improve low-temperature fixability of an electrostatic latent image developing toner and inhibit charge decay of the electrostatic latent image developing toner.

Solution to Problem

An electrostatic latent image developing toner of the present invention includes toner particles each including a toner core and a shell layer covering a surface of the toner core. The shell layer contains a hydrophilic thermosetting resin and a hydrophobic thermoplastic resin. The hydrophobic thermoplastic resin is exposed at surfaces of the toner particles.

A method for producing an electrostatic latent image developing toner according to the present invention includes a toner core production process and a shell layer formation process. In the toner core production process, toner cores are produced. In the shell layer formation process, the toner cores obtained in the toner core production process, the hydrophilic thermosetting resin or a precursor thereof, and the hydrophobic thermoplastic resin or a precursor thereof are added to an aqueous medium to cause the hydrophobic thermoplastic resin or the precursor thereof to adhere to surfaces of the toner cores in the aqueous medium. Also, in the shell layer formation process, the shell layers containing the hydrophilic thermosetting resin and the hydrophobic thermoplastic resin are formed on the respective surfaces of the toner cores by heating the aqueous medium.

Advantageous Effects of Invention

According to the present invention, low-temperature fixability of the electrostatic latent image developing toner can be improved and charge decay of the electrostatic latent image developing toner can be inhibited.

DESCRIPTION OF EMBODIMENTS

Figure 1:
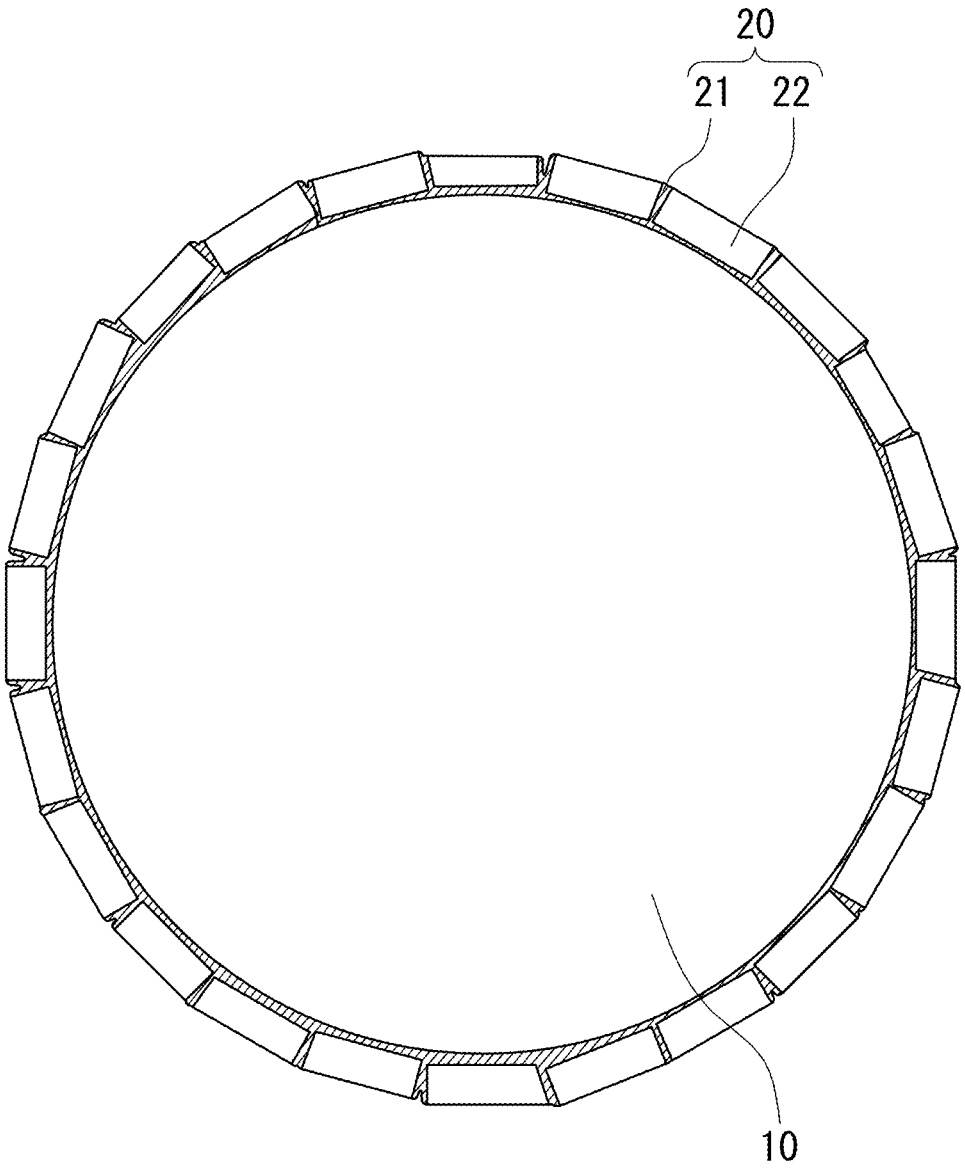
FIG. 1 is a diagram illustrating an example of a toner particle included in a toner according to an embodiment of the present invention.

The following describes an embodiment of the present invention in detail. Evaluation results (for example, values indicating shape and physical properties) for a powder (specific examples include toner cores, toner mother particles, an external additive, and a toner) are each a number average of values measured for a suitable number of particles that are selected as average particles within the powder, unless otherwise stated. A number average particle diameter of a powder is a number average value of equivalent circular diameters of primary particles of the powder (diameters of circles having the same areas as projected areas of the particles) measured using a microscope, unless otherwise stated. In the following description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acrylic acid" is used as a generic term for both acrylic acid and methacrylic acid.

A toner according the present embodiment is an electrostatic latent image developing toner. The toner according to the present embodiment is a powder formed by a large number of toner particles. The toner according to the present embodiment can be used, for example, in an electrophotographic apparatus (image forming apparatus).

The following describes an example of a method by which an electrophotographic apparatus forms an image. First, an electrostatic latent image is formed on a photosensitive member based on image data. Next, the formed electrostatic latent image is developed using a developer that includes a toner. In the development process, charged toner is caused to adhere to the electrostatic latent image such that a toner image is formed on the photosensitive member. In a subsequent transfer process, the toner image on the photosensitive member is transferred to a transfer belt and thereafter the toner image on the transfer belt is further transferred to a recording medium (for example, paper). Thereafter, the toner is heated in order to fix the toner to the recording medium. Through the method described above, an image is formed on the recording medium. A full-color image can for example be formed by superposing toner images of four different colors: black, yellow, magenta, and cyan.

The toner according to the present embodiment has the following features (1) and (2).

(1) Toner particles each include a toner core and a shell layer covering a surface of the toner core. The shell layer contains a hydrophilic thermosetting resin and a hydrophobic thermoplastic resin.

(2) The hydrophobic thermoplastic resin is exposed at surfaces of the toner particles.

The feature (1) is effective to achieve both high-temperature preservability and low-temperature fixability of the toner. Specifically, the shell layer covering each toner core is thought to improve high-temperature preservability of the toner. Also, the hydrophilic thermosetting resin is thought to improve high-temperature preservability of the toner and the hydrophobic thermoplastic resin is thought to improve low-temperature fixability of the toner.

The feature (2) is effective to inhibit charge decay of the toner. Specifically, due to the hydrophobic thermoplastic resin exposed at the surfaces of the toner particles, adsorption of moisture to the surfaces of the toner particles is unlikely to occur even in an environment of high temperature and high humidity. Therefore, charge retention of the toner is improved and charge decay of the toner is inhibited.

The toner according to the present embodiment includes toner particles having both the features (1) and (2) (hereinafter referred to toner particles according to the present embodiment). The toner including the toner particles according to the present embodiment has excellent low-temperature fixability and charge retention (see Table 1 shown further below). An amount of the toner particles according to the present embodiment contained in the toner is preferably at least 80% by mass, more preferably at least 90% by mass, and further preferably 100% by mass.

In order to achieve both low-temperature fixability and high-temperature preservability of the electrostatic latent image developing toner, the toner preferably has the following feature (3) in addition to the features (1) and (2).

(3) In the shell layer, a plurality of blocks substantially formed from the hydrophobic thermoplastic resin are connected to one another through a junction portion substantially formed from the hydrophilic thermosetting resin. An additive may be dispersed in the hydrophobic thermoplastic resin forming the blocks. Also, an additive may be dispersed in the hydrophilic thermosetting resin forming the junction portion. An amount of the hydrophobic thermoplastic resin contained in the blocks is preferably at least 80% by mass relative to a total mass of the blocks, more preferably at least 90% by mass, and most preferably 100% by mass. An amount of the hydrophilic thermosetting resin contained in the junction portion is preferably at least 80% by mass relative to a total mass of the junction portion, more preferably at least 90% by mass, and most preferably 100% by mass.

Figure 2:
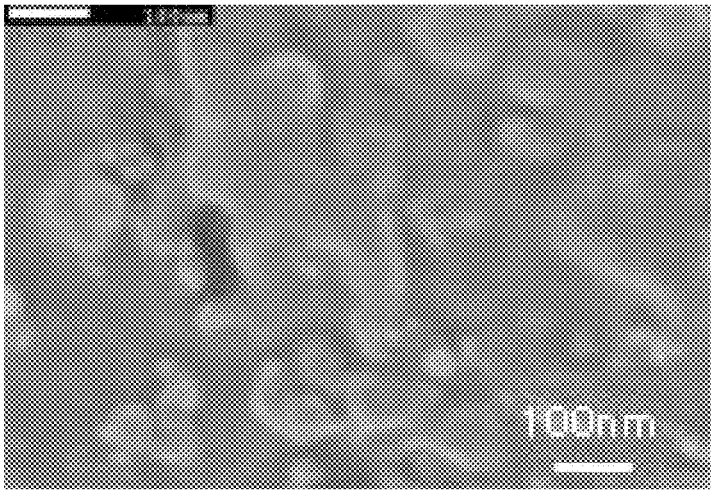
FIG. 2 is a photograph of a surface of a toner particle in a toner according to an embodiment of the present invention, which photograph was taken using a scanning electron microscope.
Figure 3:
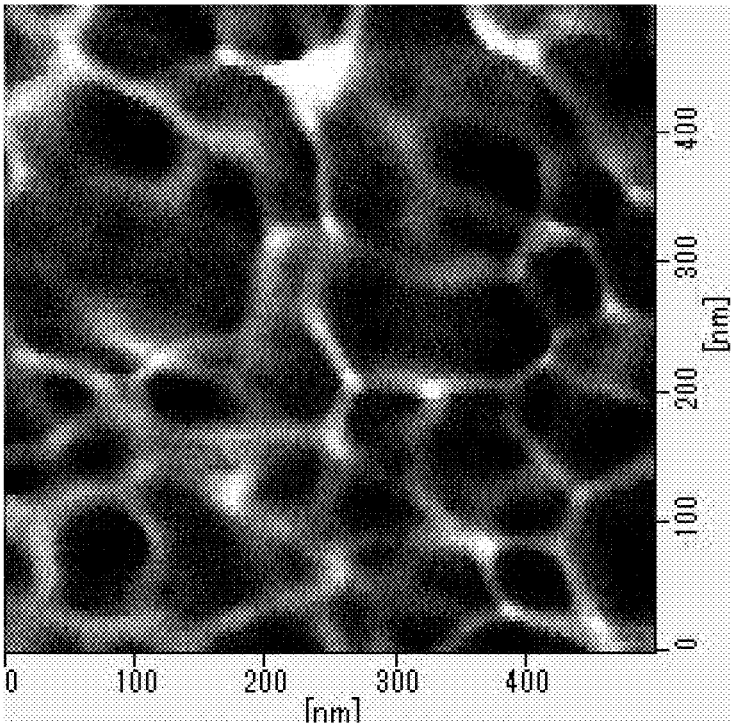
FIG. 3 is a photograph of a surface of a toner particle in a toner according to an embodiment of the present invention, which photograph was taken using a scanning probe microscope.

The following describes an example of the toner having the features (1) to (3) with reference to FIGS. 1 to 3.

FIG. 1 illustrates a toner particle included in the toner according to the present embodiment. The toner particle includes a toner core 10 and a shell layer 20 covering the toner core 10. The shell layer 20 includes a junction portion 21 and a plurality of blocks 22. The junction portion 21 is substantially formed from a hydrophilic thermosetting resin. The blocks 22 are each substantially formed from a hydrophobic thermoplastic resin. In the shell layer 20, the minute blocks 22 of the hydrophobic thermoplastic resin are formed in regions separated from one another by the junction portion 21 formed from the hydrophilic thermosetting resin. For example, all the blocks 22 are exposed at the surface of the toner particle. However, the present invention is not limited to this configuration, and the shell layer 20 may also include blocks 22 that are not exposed at the surface of the toner particle.

FIG. 2 is a photograph (SEM photograph) of a toner particle in the toner having the features (1) to (3), which photograph was taken using a scanning electron microscope. FIG. 3 is a photograph (SPM photograph) of a toner particle in the toner having the features (1) to (3), which photograph was taken using a scanning probe microscope. As shown in FIGS. 2 and 3, a surface (shell layer 20) of the toner particle has a sea-island structure. The sea-island structure as shown in FIGS. 2 and 3 is formed by the blocks 22 of the hydrophobic thermoplastic resin and the junction portion 21 formed from the hydrophilic thermosetting resin.

Figure 4:
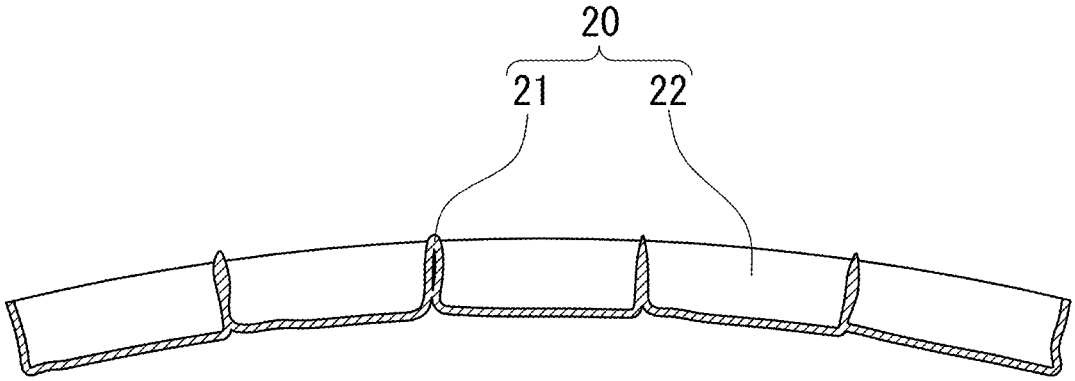
FIG. 4 is a diagram illustrating an example of a structure of a shell layer of a toner according to an embodiment of the present invention.

FIG. 4 is a diagram illustrating an example of a structure of the shell layer 20 in the toner having the features (1) to (3). The following further describes the structure of the shell layer 20 mainly with reference to FIGS. 1 and 4.

As illustrated in FIGS. 1 and 4, the junction portion 21 is present between each block 22 and other blocks 22. Each block 22 is separated from other blocks 22 by the junction portion 21 located between the blocks 22 (a wall of the junction portion 21). The junction portion 21 is also present in gaps between the blocks 22 and the toner core 10. The junction portion 21 present in the gaps between the blocks 22 and the toner core 10 (a film of the junction portion 21) connects one wall of the junction portion 21 to another wall of the junction portion such that the entirety of the junction portion 21 has an integrated structure. However, the present invention is not limited to this configuration, and a part of the junction portion 21 may be separated from other parts thereof.

The hydrophobic thermoplastic resin softens when it is heated to or beyond a glass transition point (Tg) thereof. However, the hydrophobic thermoplastic resin (blocks 22) is partitioned by the hydrophilic thermosetting resin (junction portion 21) in the shell layer of the toner having the features (1) to (3). Therefore, the toner particles tend not to deform even when a temperature of the shell layer reaches Tg of the hydrophobic thermoplastic resin. In a toner such as described above, deformation of toner particles only begins once heat and pressure are simultaneously applied to the toner particles. Further, toner particles in such a toner are inhibited from agglomerating in a state in which force is not applied to the toner. Therefore, both high-temperature preservability and low-temperature fixability of the toner having the features (1) to (3) are excellent.

The toner particles each include the toner core and the shell layer covering the surface of the toner core. The toner core contains a binder resin. The toner particles may each contain optional components (for example, one or more of a colorant, a releasing agent, a charge control agent, and a magnetic powder) in the binder resin as necessary.

An external additive may be added to the surface of each toner particle (toner mother particle) as necessary. In the following description, a toner particle prior to treatment with an external additive may be referred to as a toner mother particle. It should be noted that a plurality of shell layers may be layered on the surface of each toner core.

The toner may be used as a one-component developer. Alternatively, the toner may be mixed with a carrier to prepare a two-component developer.

[Toner Core]

(Binder Resin)

The binder resin is typically a main component (for example, at least 85% by mass) of the toner core. Properties of the binder resin are therefore thought to have a great influence on properties of the toner core as a whole. For example, the toner core is highly likely to be anionic in a situation in which the binder resin has an ester group, a hydroxyl group, an ether group, an acid group, or a methyl group. By contrast, the toner core is highly likely to be cationic in a situation in which the binder resin has an amino group or an amide group. In order that the binder resin is strongly anionic, at least one of a hydroxyl value (measured according to JIS (Japanese Industrial Standard) K0070-1992) and an acid value (measured according to JIS (Japanese Industrial Standard) K0070-1992) of the binder resin is preferably at least 10 mgKOH/g, and more preferably at least 20 mgKOH/g.

The binder resin preferably has at least one functional group selected from the group consisting of an ester group, a hydroxyl group, an ether group, an acid group, and a methyl group, and more preferably has either or both of a hydroxyl group and a carboxyl group. A binder resin having a functional group such as described above readily reacts with a shell material (for example, methylol melamine) to form chemical bonds. Formation of the chemical bonds ensures strong bonding between the toner core and the shell layer. Also, the binder resin preferably has a functional group including active hydrogen in molecules thereof.

The binder resin preferably has a glass transition point (Tg) of no greater than a curing onset temperature of the shell material. It is thought that as a result of using a binder resin having Tg such as described above, fixability of the toner tends to be sufficient even during high speed fixing.

Tg of the binder resin can be measured using, for example, a differential scanning calorimeter. More specifically, Tg of the binder resin can be obtained from a point of change in specific heat on a heat absorption curve of a sample (binder resin) that is plotted using the differential scanning calorimeter.

The binder resin preferably has a softening point (Tm) of no greater than 100° C., and more preferably no greater than 95° C. As a result of Tm of the binder resin being no greater than 100° C., fixability of the toner tends to be sufficient even during high speed fixing. Further, in a situation in which Tm of the binder resin is no greater than 100° C., partial softening of the toner core tends to occur during curing reaction of the shell layer when the shell layer is formed on the surface of the toner core in an aqueous medium, and as a result, the toner core tends to become round in shape due to surface tension. Tm of the binder resin can be adjusted by using a combination of a plurality of resins having respective Tm different from each other.

Tm of the binder resin can be measured using, for example, a capillary rheometer. More specifically, melt flow of a sample (binder resin) set in the capillary rheometer is caused under specific conditions. An S-shaped curve is plotted for the binder resin. Tm of the binder resin can be read from the plotted S-shaped curve. Tm of the measurement sample (binder resin) is a temperature (° C.) on the plotted S-shaped curve corresponding to a stroke value of "$(S_1+S_2)/2$", where $S_1$ represents a maximum stroke value and $S_2$ represents a baseline stroke value at low temperatures.

The binder resin is preferably a thermoplastic resin. Preferable examples of thermoplastic resins that can be used as the binder resin include styrene-based resins, acrylic acid-based resins, olefin-based resins (specific examples include polyethylene resins and polypropylene resins), vinyl resins (specific examples include vinyl chloride resins, polyvinyl alcohols, vinyl ether resins, and N-vinyl resins), polyester resins, polyamide resins, urethane resins, styrene-acrylic acid-based resins, and styrene-butadiene-based resins. Among the above-listed resins, styrene-acrylic acid-based resins and polyester resins are preferable in order to improve dispersibility of a colorant in the toner core, chargeability of the toner, and fixability of the toner with respect to a recording medium.

The following describes a styrene-acrylic acid-based resin that can be used as the binder resin. The styrene-acrylic acid-based resin is a copolymer of at least one type of styrene-based monomer and at least one type of acrylic acid-based monomer.

Preferable examples of styrene-based monomers include styrene, α-methylstyrene, p-hydroxy styrene, m-hydroxy styrene, vinyltoluene, α-chlorostyrene, o-chlorostyrene, m-chlorostyrene, p-chlorostyrene, and p-ethylstyrene.

Preferable examples of acrylic acid-based monomers include (meth)acrylic acid, (meth)acrylic acid alkyl esters, and (meth)acrylic acid hydroxyalkyl esters. Examples of (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate. Examples of (meth)acrylic acid hydroxyalkyl esters include 2-hydroxyethyl (meth)acrylate, 3-hydroxypropyl (meth)acrylate, 2-hydroxypropyl (meth)acrylate, and 4-hydroxybutyl (meth) acrylate.

A hydroxyl group can be introduced into the styrene-acrylic acid-based resin by using a monomer having a hydroxyl group (specific examples include p-hydroxystyrene, m-hydroxystyrene, and (meth)acrylic acid hydroxyalkyl esters) in preparation of the styrene-acrylic acid-based resin. A hydroxyl value of the styrene-acrylic acid-based resin can be adjusted by adjusting an amount of use of the monomer having the hydroxyl group.

A carboxyl group can be introduced into the styrene-acrylic acid-based resin by using (meth)acrylic acid (monomer) in preparation of the styrene-acrylic acid-based resin. An acid value of the styrene-acrylic acid-based resin can be adjusted by adjusting an amount of use of (meth)acrylic acid.

In a situation in which the styrene-acrylic acid-based resin is used as the binder resin, the styrene-acrylic acid-based resin preferably has a number average molecular weight (Mn) of at least 2,000 and no greater than 3,000 in order to achieve both sufficient strength of the toner core and sufficient fixability of the toner. The styrene-acrylic acid-based resin preferably has a molecular weight distribution (ratio (Mw/Mn) of a mass average molecular weight (Mw) to the number average molecular weight (Mn)) of at least 10 and no greater than 20. Mn and Mw of the styrene-acrylic acid-based resin can be measured by gel permeation chromatography.

The following describes a polyester resin that can be used as the binder resin. The polyester resin can be prepared through condensation polymerization of at least one alcohol and at least one carboxylic acid.

Examples of dihydric alcohols that can be used to prepare the polyester resin include diols and bisphenols.

Preferable examples of diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, bisphenol A ethylene oxide adduct, and bisphenol A propylene oxide adduct.

Preferable examples of tri- or higher-hydric alcohols that can be used to prepare the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of dibasic carboxylic acids that can be used to prepare the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Preferable examples of tri- or higher-basic carboxylic acids that can be used to prepare the polyester resin include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Alternatively, an ester-forming derivative (for example, an acid halide, an acid anhydride, or a lower alkyl ester) of any of the di-, tri-, or higher-basic carboxylic acids listed above may be used. In the present description, the term "lower alkyl" refers to an alkyl group having a carbon number of 1-6.

An acid value and a hydroxyl value of the polyester resin can be adjusted by changing an amount of alcohol and an amount of carboxylic acid, respectively, used in preparation of the polyester resin. An increase in molecular weight of the polyester resin tends to cause a decrease in the acid value and the hydroxyl value of the polyester resin.

In a situation in which the polyester resin is used as the binder resin, the polyester resin preferably has a number average molecular weight (Mn) of at least 1,000 and no greater than 2,000 in order to achieve both sufficient strength of the toner core and sufficient fixability of the toner. The polyester resin preferably has a molecular weight distribution (ratio (Mw/Mn) of a mass average molecular weight (Mw) to the number average molecular weight (Mn)) of at least 9 and no greater than 21. Mn and Mw of the polyester resin can be measured by gel permeation chromatography.

(Colorant)

The toner core may contain a colorant. A known pigment or dye that matches the color of the toner can be used as the colorant. An amount of the colorant is preferably at least 1 part by mass and no greater than 20 parts by mass relative to 100 parts by mass of the binder resin, and more preferably at least 3 parts by mass and no greater than 10 parts by mass.

The toner core may contain a black colorant. An example of the black colorant is carbon black. Alternatively, the black colorant may be a colorant that is adjusted to a black color using a yellow colorant, a magenta colorant, and a cyan colorant.

The toner core may contain a non-black colorant such as a yellow colorant, a magenta colorant, or a cyan colorant.

Examples of yellow colorants include condensed azo compounds, isoindolinone compounds, anthraquinone compounds, azo metal complexes, methine compounds, and arylamide compounds. Preferable examples of yellow colorants include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Preferable examples of magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of cyan colorants include copper phthalocyanine compounds, anthraquinone compounds, and basic dye lake compounds. Preferable examples of cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner core may contain a releasing agent. The releasing agent is for example used in order to improve fixability of the toner or resistance of the toner to being offset. In order to increase anionic strength of the toner core, the toner core is preferably prepared using an anionic wax. In order to improve fixability of the toner or resistance of the toner to being offset, an amount of the releasing agent is preferably at least 1 part by mass and no greater than 30 parts by mass relative to 100 parts by mass of the binder resin, and more preferably at least 5 parts by mass and no greater than 20 parts by mass.

Preferable examples of releasing agents include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax.

A compatibilizer may be added to the toner core in order to improve compatibility between the binder resin and the releasing agent.

(Charge Control Agent)

The toner core may contain a charge control agent. The charge control agent is for example used in order to improve charge stability or a charge rise characteristic of the toner. Anionic strength of the toner core can be increased by including a negatively chargeable charge control agent in the toner core. The charge rise characteristic of the toner is an indicator as to whether the toner can be charged to a specific charge level in a short period of time.

(Magnetic Powder)

The toner core may contain a magnetic powder. Examples of materials of the magnetic powder that can be preferably used include ferromagnetic metals (specific examples include iron, cobalt, and nickel), alloys of such ferromagnetic metals, ferromagnetic metal oxides (specific examples include ferrite, magnetite, and chromium dioxide), and materials subjected to ferromagnetization (specific examples include thermal treatment). A single type of magnetic powder may be used alone, or plural types of magnetic powders may be used in combination.

The magnetic powder is preferably subjected to surface treatment in order to inhibit elution of metal ions (for example, iron ions) from the magnetic powder. In a situation in which the shell layer is formed on the surface of each toner core under an acidic condition, elution of metal ions to the surfaces of the toner cores tends to cause adhesion of the toner cores to one another. Adhesion of the toner cores to one another can be inhibited by inhibiting elution of the metal ions from the magnetic powder.

[Shell Layer]

The shell layer contains a hydrophilic thermosetting resin and a hydrophobic thermoplastic resin. Therefore, the shell layer having a uniform thickness tends to be formed on the surface of each toner core. Also, a charge amount of the toner can be easily adjusted to fall within a desired range since the shell layer contains the hydrophobic thermoplastic resin in addition to the hydrophilic thermosetting resin. The shell layer may contain a charge control agent (for example, positively chargeable charge control agent).

The hydrophobic thermoplastic resin preferably has a functional group (for example, a hydroxyl group, a carboxyl group, an amino group, a carbodiimide group, an oxazoline group, or a glycidyl group) that readily reacts with a functional group (for example, a methylol group or an amino group) of the hydrophilic thermosetting resin. The amino group may be included in the hydrophobic thermoplastic resin in the form of a carbamoyl group (—$CONH_2$).

In order to improve film quality of the shell layer, the hydrophobic thermoplastic resin preferably includes a repeating unit derived from an acrylic acid-based monomer. Also, the hydrophobic thermoplastic resin preferably includes a repeating unit that has an alcoholic hydroxyl group, and particularly preferably includes a repeating unit derived from 2-HEMA (2-hydroxyethyl methacrylate). Preferable examples of monomers that can be used to include the repeating unit having the alcoholic hydroxyl group in the shell layer include (meth)acrylic acid 2-hydroxyalkyl esters such as 2-hydroxyethyl acrylate (HEA), 2-hydroxypropyl acrylate (HPA), 2-hydroxyethyl methacrylate (HEMA), and 2-hydroxypropyl methacrylate.

Specific examples of the hydrophobic thermoplastic resin include acrylic acid-based resins, styrene-acrylic acid-based copolymers, silicone-acrylic acid-based graft copolymers, urethane resins, polyester resins, and ethylene-vinyl alcohol copolymers. The hydrophobic thermoplastic resin is preferably an acrylic acid-based resin, a styrene-acrylic acid-based copolymer, or a silicone-acrylic acid-based graft copolymer, and more preferably an acrylic acid-based resin.

Examples of acrylic acid-based monomers that can be used to include the hydrophobic thermoplastic resin in the shell layer include: (meth)acrylic acid alkyl esters such as methyl (meth)acrylate, ethyl (meth)acrylate, n-propyl (meth)acrylate, and n-butyl (meth)acrylate; (meth)acrylic acid aryl esters such as phenyl (meth)acrylate; (meth)acrylic acid hydroxyalkyl esters such as 2-hydroxyethyl (meth) acrylate, 3-hydroxypropyl (meth)acrylate, 2-hydroxypropyl (meth)acrylate, and 4-hydroxybutyl (meth)acrylate; (meth) acrylamide; (meth)acrylic acid ethylene oxide adduct; and alkyl ethers (for example, methyl ether, ethyl ether, n-propyl ether, and n-butyl ether) of ethylene oxide adduct of a (meth)acrylic acid ester.

Preferable examples of the hydrophilic thermosetting resin include melamine resins, urea resins, sulfonamide resins, glyoxal resins, guanamine resins, aniline resins, polyimide resins, and derivatives of the aforementioned resins. A polyimide resin includes nitrogen atoms in a molecular backbone thereof. Therefore, a shell layer that contains a polyimide resin tends to be strongly cationic. Examples of polyimide resins include maleimide-based polymers and bismaleimide-based polymers (specific examples include amino-bismaleimide polymer and bismaleimide-triazine polymer).

A resin produced through polycondensation of an aldehyde (for example, formaldehyde) and a compound having an amino group is particularly preferable as the hydrophilic thermosetting resin. Note that a melamine resin is a polycondensate of melamine and formaldehyde. A urea resin is a polycondensate of urea and formaldehyde. A glyoxal resin is a polycondensate of formaldehyde and a reaction product of glyoxal and urea.

Cross-link curing by the hydrophilic thermosetting resin can be improved through inclusion of nitrogen atoms in the hydrophilic thermosetting resin. In order to increase reactivity of the hydrophilic thermosetting resin, nitrogen content is preferably adjusted to at least 40% by mass and no greater than 55% by mass in the case of a melamine resin-based hydrophilic thermosetting resin, approximately 40% by mass in the case of a urea resin-based hydrophilic thermosetting resin, and approximately 15% by mass in the case of a glyoxal resin-based hydrophilic thermosetting resin.

Examples of monomers that can be used to include the hydrophilic thermosetting resin in the shell layer include methylol melamine, benzoguanamine, acetoguanamine, spiroguanamine, and dimethylol dihydroxyethyleneurea (DMDHEU).

The shell layer may have fractures (portions having low mechanical strength). The fractures can for example be formed by causing localized defects to occur in the shell layer. Formation of the fractures enables the shell layer to be fractured more easily. As a result, the toner can be fixed to a recording medium at low temperatures. Any number of fractures may be provided.

[External Additive]

An external additive may be caused to adhere to the surface of each toner particle as necessary. Examples of external additives include fine particles of metal oxides (specific examples include alumina, titanium oxide, magnesium oxide, zinc oxide, strontium titanate, and barium titanate) and fine particles of silica.

The external additive preferably has a particle diameter of at least 0.01 μm and no greater than 1.0 μm. An amount of the external additive is preferably at least 0.5 parts by mass and no greater than 10 parts by mass relative to 100 parts by mass of the toner mother particles, and more preferably at least 1 part by mass and no greater than 5 parts by mass.

[Carrier]

The toner according to the present embodiment can be mixed with a carrier to prepare a two-component developer. A magnetic carrier is preferably used in preparation of the two-component developer.

An example of preferable carriers is a powder formed by carrier particles each including a carrier core covered by a resin. Specific examples of carrier cores include: particles of iron, oxidized iron, reduced iron, magnetite, copper, silicon steel, ferrite, nickel, and cobalt; particles of alloys of the aforementioned materials and metals such as manganese, zinc, and aluminum; particles of iron-nickel alloy and iron-cobalt alloy; particles of ceramics (specific examples include titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate); and particles of high-dielectric substances (specific examples include ammonium dihydrogen phosphate, potassium dihydrogen phosphate, and Rochelle salt). In a situation in which the carrier cores are formed from a resin, the above-listed particles (for example, ferrite particles) may be dispersed in the resin forming the carrier cores.

Examples of resins that can be used to cover the carrier cores include acrylic acid-based polymers, styrene-based polymers, styrene-acrylic acid-based copolymers, olefin-based polymers (specific examples include polyethylene, chlorinated polyethylene, and polypropylene), polyvinyl chlorides, polyvinyl acetates, polycarbonates, cellulose resins, polyester resins, unsaturated polyester resins, polyamide resins, urethane resins, epoxy resins, silicone resins, fluororesins (specific examples include polytetrafluoroethylene, polychlorotrifluoroethylene, and polyvinylidene fluoride), phenolic resins, xylene resins, diallyl phthalate resins, polyacetal resins, and amino resins. A combination of two or more of the above-listed resins may be used.

The carrier preferably has a particle diameter, as measured using an electron microscope, of at least 20 μm and no greater than 120 μm, and more preferably at least 25 μm and no greater than 80 μm.

In a situation in which the toner and the carrier are used to prepare a two-component developer, an amount of the toner is preferably at least 3% by mass and no greater than 20% by mass relative to a mass of the two-component developer, and more preferably at least 5% by mass and no greater than 15% by mass.

[Method for Producing Toner]

The following describes a method for producing the electrostatic latent image developing toner according to the present embodiment. The method for producing the electrostatic latent image developing toner according to the present embodiment includes a toner core production process and a shell layer formation process. In the toner core production process, toner cores are produced. In the shell layer formation process, the toner cores obtained in the toner core production process, a hydrophilic thermosetting resin or a precursor thereof, and a hydrophobic thermoplastic resin or a precursor thereof are added to an aqueous medium, and the hydrophobic thermoplastic resin or the precursor thereof is caused to adhere to the surface of each toner core in the aqueous medium. Further, in the shell layer formation process, the aqueous medium containing the shell materials (the hydrophilic thermosetting resin or the precursor thereof, and the hydrophobic thermoplastic resin or the precursor thereof) is heated to form the shell layer containing the hydrophilic thermosetting resin and the hydrophobic thermoplastic resin on the surface of each toner core.

(Toner Core Production Process)

Examples of preferable toner core production processes include a pulverization method and an aggregation method.

In the pulverization method, a binder resin and internal additives (for example, a colorant, a releasing agent, a charge control agent, and a magnetic powder) are mixed. Subsequently, the resultant mixture is melted and kneaded. Subsequently, the resultant kneaded product is pulverized. Subsequently, the resultant pulverized product is classified. As a result, toner cores having a desired particle diameter are produced. The pulverization method enables relatively simple production of toner cores.

The aggregation method for example includes an aggregation step and a coalescence step. In the aggregation step, plural types of fine particles each containing a component of the toner cores (for example, binder resin fine particles, colorant fine particles, and releasing agent fine particles) are caused to aggregate in an aqueous medium to form aggregated particles. In the coalescence step, the components contained in the aggregated particles are caused to coalesce in the aqueous medium to form toner cores. The aggregation method enables production of toner cores that tend to be uniform in shape and particle diameter.

(Shell Layer Formation Process)

In the shell layer formation process, the shell layer is formed on the surface of each toner core. The shell layer is formed using for example a hydrophilic thermosetting resin precursor (for example, a monomer or a prepolymer of a hydrophilic thermosetting resin) and a hydrophobic thermoplastic resin precursor (for example, a prepolymer of a hydrophobic thermoplastic resin). Specifically, the toner cores obtained in the toner core production process, the hydrophilic thermosetting resin precursor, and the hydrophobic thermoplastic resin precursor are added to an aqueous medium. Note that the hydrophobic thermoplastic resin may be added to the aqueous medium instead of the hydrophobic thermoplastic resin precursor. Also, the hydrophilic thermosetting resin may be added to the aqueous medium instead of the hydrophilic thermosetting resin precursor. Although the hydrophobic thermoplastic resin does not dissolve in the aqueous medium, the hydrophilic thermosetting resin readily dissolves in the aqueous medium.

Formation of the shell layer is preferably carried out in the aqueous medium in order to prevent dissolution of the binder resin or elution of the releasing agent. The aqueous medium is a medium in which water is a main component (specific examples include pure water and a liquid mixture of water and a polar medium). The aqueous medium may function as a solvent. A solute may be dissolved in the aqueous medium. The aqueous medium may function as a dispersion medium. A dispersoid may be dispersed in the aqueous medium. Examples of polar mediums that can be used in the aqueous medium include alcohols (specific examples include methanol and ethanol). The aqueous medium has a boiling point of approximately 100° C.

Figure 5:
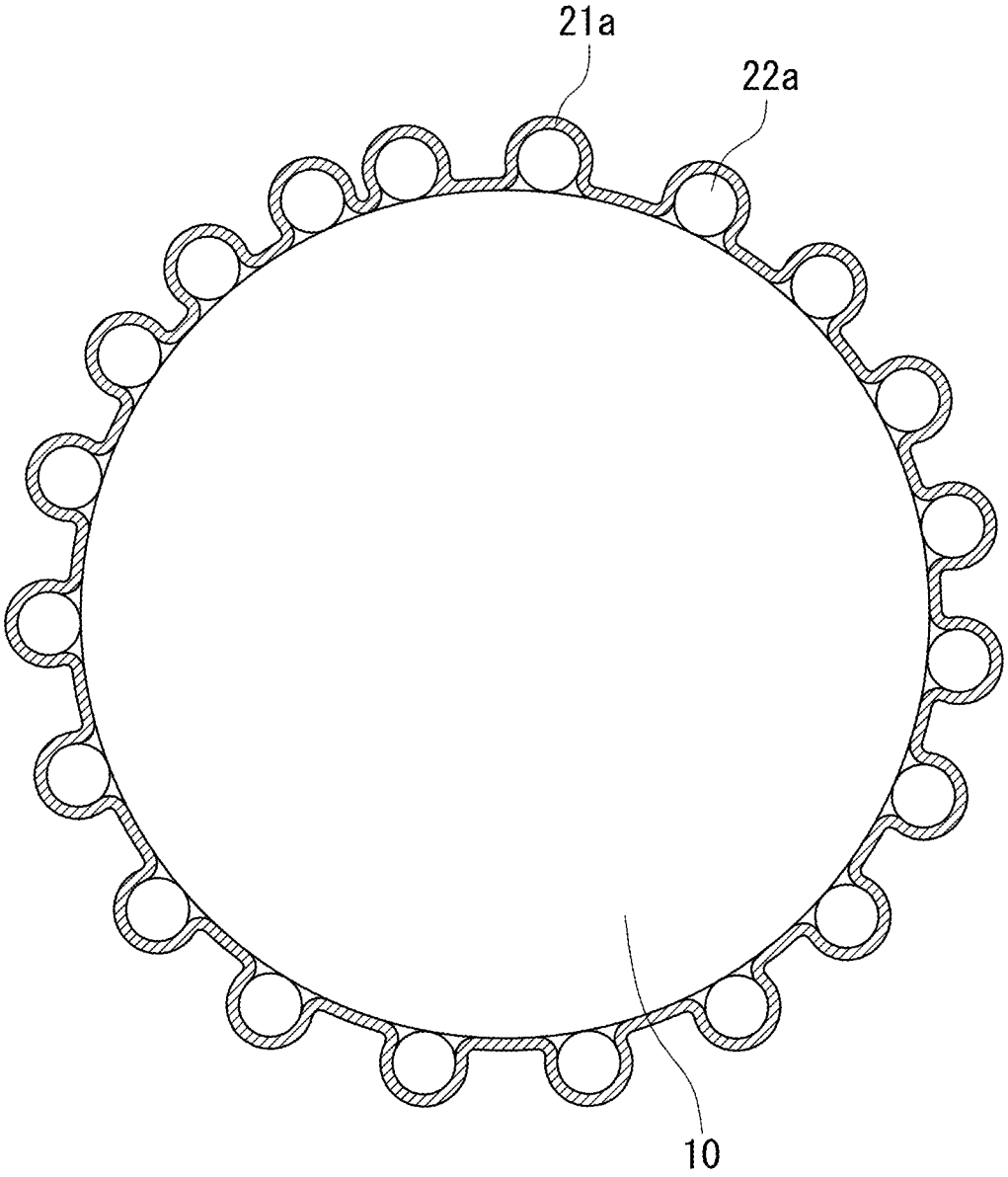
FIG. 5 is a diagram for explaining a step for causing a hydrophobic thermoplastic resin precursor to adhere to surfaces of toner cores in a method for producing a toner according to an embodiment of the present invention.
Figure 6:
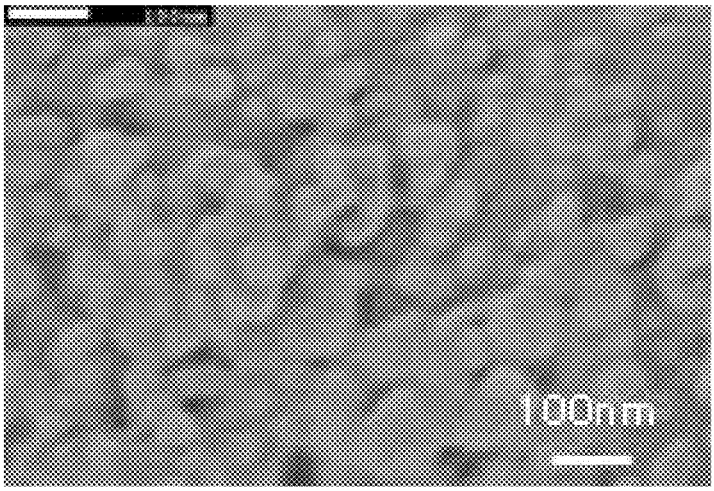
FIG. 6 is a photograph of a surface of a toner core to which a hydrophilic thermosetting resin precursor and the hydrophobic thermoplastic resin precursor are caused to adhere by the step illustrated in FIG. 5, which photograph was taken using a scanning electron microscope.
Figure 7:
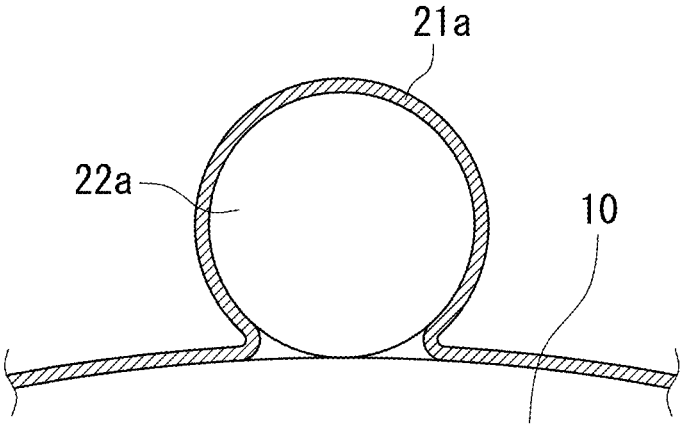
FIG. 7 is an enlarged view of a part of a surface of a toner core to which the hydrophilic thermosetting resin precursor and the hydrophobic thermoplastic resin precursor are caused to adhere by the step illustrated in FIG. 5.

The following describes an example of the shell layer formation process mainly with reference to FIGS. 5 to 7. FIGS. 5 to 7 each illustrate a surface of a toner core to which a hydrophilic thermosetting resin precursor and a hydrophobic thermoplastic resin precursor adhere. FIG. 6 is a photograph (SEM photograph) taken using a scanning electron microscope.

When the toner cores and the above-described shell materials (the hydrophilic thermosetting resin precursor and the hydrophobic thermoplastic resin precursor) are added to the aqueous medium, particles of the hydrophobic thermoplastic resin precursor adsorb to the surface of each toner core in the aqueous medium. Further, the hydrophilic thermosetting resin precursor covers the surface of each toner core to which the particles of the hydrophobic thermoplastic resin precursor adhere. Specifically, a film 21*a* of the hydrophilic thermosetting resin precursor and particles 22*a* of the hydrophobic thermoplastic resin precursor form on the surface of each toner core as illustrated in FIG. 5. The film 21*a* and the particles 22*a* each adhere to the surface of the toner core.

The hydrophobic thermoplastic resin precursor is thought to aggregate to form the particles 22*a*, rather than spreading out in the aqueous medium, due to hydrophobicity of the hydrophobic thermoplastic resin precursor. In the SEM photograph of FIG. 6, presence of a plurality of particles 22*a* can be confirmed at the surface of the toner core covered by the film 21*a*. It is thought that the particles 22*a* are each surrounded by the toner core 10 and the film 21*a* and not exposed to the aqueous medium (there is almost no contact between the particles and the aqueous medium), as illustrated in FIG. 7.

Subsequently, the aqueous medium (specifically, a dispersion of toner cores on which the film 21*a* and the particles 22*a* are formed) is stirred while being heated to a specific temperature and then maintained at the specific temperature for a specific time. Through the above, curing of the shell materials (the hydrophilic thermosetting resin precursor and the hydrophobic thermoplastic resin precursor) adhering to the surface of each toner core occurs through reaction. As a result, the shell layer is formed on the surface of each toner core, and a dispersion of toner mother particles is obtained.

The shell materials (the hydrophobic thermoplastic resin precursor and the hydrophilic thermosetting resin precursor) each adhere to the toner core prior to curing of the shell layer. It is though that, as a result of the above, particles of the hydrophobic thermoplastic resin precursor do not fuse with one another on the surface of each toner core even when the shell layer is cured by heating. Further, it is thought that the hydrophilic thermosetting resin precursor is present at an interface between the aqueous medium and each particle of the hydrophobic thermoplastic resin precursor due to strong hydrophilicity of the hydrophilic thermosetting resin precursor prior to heating. However, hydrophilicity of the hydrophilic thermosetting resin precursor tends to weaken as the curing reaction of the shell layer proceeds. The above is thought to cause the hydrophilic thermosetting resin precursor to move into gaps between the blocks of the hydrophobic thermoplastic resin and gaps between the blocks of the hydrophobic thermoplastic resin and the toner core during the curing reaction of the shell layer as a result of capillary effect.

The toner cores can be sufficiently dispersed in the aqueous medium for example by a method of dispersing the toner cores in the aqueous medium in a mechanical manner using a device capable of stirring the dispersion with powerful force.

A pH of the aqueous medium is preferably adjusted to approximately 4 using an acidic substance before addition of the materials for forming the shell layer. Adjustment of the aqueous medium to an acidic pH promotes the reaction by which the shell layer is formed.

In order that formation of the shell layer proceeds favorably, formation of the shell layer on the surface of each toner core is carried out at a temperature of preferably at least 40° C. and no greater than 95° C., and more preferably at least 50° C. and no greater than 80° C.

After the shell layer is formed as described above, the dispersion containing the toner mother particles is cooled to normal temperature. Thereafter, a process for washing the toner mother particles (washing process), a process for drying the toner mother particles (drying process), and a process for causing an external additive to adhere to the surface of each toner mother particle (external addition process) are performed as necessary. Through the above, the toner is obtained.

In the washing process, the toner mother particles are washed with water. Examples of preferable washing methods include: a method of collecting a wet cake of the toner mother particles from the dispersion containing the toner mother particles by solid-liquid separation, and washing the collected wet cake of the toner mother particles with water; and a method of causing sedimentation of the toner mother particles in the dispersion, exchanging a supernatant with water, and subsequently redispersing the toner mother particles in water.

In the drying process, the toner mother particles are dried. Examples of preferable methods for drying the toner mother particles include use of a dryer (specific examples include a spray dryer, a fluidized bed dryer, a vacuum freeze dryer, or a reduced pressure dryer). Use of a spray dryer is preferable in order to prevent agglomeration of the toner mother particles during drying. The spray dryer can be used to cause an external additive such as silica to adhere to the surface of each toner mother particle by spraying the toner mother particles with a dispersion of the external additive.

In the external addition process, an external additive is caused to adhere to the surface of each toner mother particle. Examples of preferable methods for causing adhesion of the external additive include a method of mixing the toner mother particles and the external additive using a mixer (specific examples include an FM mixer and a Nauta mixer (registered Japanese trademark)) under such conditions that the external additive is not embedded in the surfaces of the toner mother particles.

The above-described method for producing the toner may be altered as appropriate in accordance with requirements of the toner, such as in terms of composition and properties. The toner cores may be added to the aqueous medium after adding the materials of the shell layer to the aqueous medium. Alternatively, the materials of the shell layer may be added to the aqueous medium after adding the toner cores to the aqueous medium. The shell layer may be formed by any process. The shell layer may for example be formed by any of an in-situ polymerization process, an in-liquid curing film coating process, and a coacervation process. Various processes may be omitted depending on intended use of the toner. In a situation in which an external additive is not caused to adhere to the surfaces of the toner mother particles (the external addition process is omitted), the toner mother particles and the toner particles are equivalent. In order to produce the toner efficiently, preferably a large number of toner particles are formed at the same time.

EXAMPLES

The following describes Examples of the present invention. Table 1 indicates toners (electrostatic latent image developing toners) of Examples 1 to 7 and Comparative Examples 1 to 3.

TABLE 1

| | Thermoplastic resin | | | Thermosetting resin | | Toner |
|---|---|---|---|---|---|---|
| | Type | Property | Amount [mL] | Property | Amount [mL] | surface Property |
| Example 1 | I | Hydrophobic | 150 | Hydrophilic | 0.35 | Hydrophobic |
| Example 2 | II | | 150 | | | |
| Example 3 | III | | 150 | | | |
| Example 4 | I | | 150 | Hydrophilic | 0.60 | |
| Example 5 | I | | 150 | Hydrophilic | 0.10 | |
| Example 6 | I | | 300 | Hydrophilic | 0.35 | |
| Example 7 | I | | 100 | Hydrophilic | 0.35 | |
| Comparative example 1 | IV | Hydrophilic | 27 | Hydrophilic | 0.35 | Hydrophilic |
| Comparative example 2 | I | Hydrophobic | 150 | | 1.20 | Hydrophilic |
| Comparative example 3 | I | Hydrophobic | | | — | Hydrophobic |

(Preparation of Thermoplastic Resin Fine Particles I)

First, 875 mL of ion exchanged water and 75 mL of an anionic surfactant (LATEMUL (registered Japanese trademark) WX produced by Kao Corporation, sodium polyoxyethylene alkyl ether sulfate) were added into a three-necked flask equipped with a thermometer and a stirring impeller, and having a capacity of 1 L. Thereafter, a temperature inside the flask was increased to 80° C. using a water bath. Then, a liquid mixture of 17 mL of styrene and 3 mL of butyl acrylate, and separately therefrom, a solution of 0.5 g of potassium peroxodisulfate dissolved in 30 mL of ion exchanged water were each dripped into the flask over 5 hours. The flask contents were maintained at 80° C. for 2 hours to cause polymerization of polymerizable monomers added into the flask. As a result, a suspension of hydrophobic thermoplastic resin fine particles I (solid concentration: 2% by mass) was obtained. A number average particle diameter of the thermoplastic resin fine particles I determined through observation using a transmission electron microscope was 32 nm. Tg of the thermoplastic resin fine particles I measured using a differential scanning calorimeter was 72° C.

(Preparation of Thermoplastic Resin Fine Particles II)

A suspension of hydrophobic thermoplastic resin fine particles II (solid concentration: 2% by mass) was prepared by the same method as for the thermoplastic resin fine particles I except that the amount of the anionic surfactant was changed from 75 mL to 25 mL. A number average particle diameter of the thermoplastic resin fine particles II determined through observation using a transmission electron microscope was 107 nm. Tg of the thermoplastic resin fine particles II measured using a differential scanning calorimeter was 68° C.

(Preparation of Thermoplastic Resin Fine Particles III)

A suspension of hydrophobic thermoplastic resin fine particles III (solid concentration: 2% by mass) was prepared by the same method as for the thermoplastic resin fine particles I except that the amount of styrene was changed to 20 mL. A number average particle diameter of the thermoplastic resin fine particles III determined through observation using a transmission electron microscope was 30 nm. Tg of the thermoplastic resin fine particles III measured using a differential scanning calorimeter was 103° C.

Example 1

(Production of Toner Core)

First, 750 g of a low viscosity polyester resin (Tg=38° C., Tm=65° C.), 100 g of a medium viscosity polyester resin (Tg=53° C., Tm=84° C.), 150 g of a high viscosity polyester resin (Tg=71° C., Tm=120° C.), 55 g of a releasing agent (carnauba wax: Carnauba Wax No. 1 produced by S. Kato & Co.), and 40 g of a colorant (phthalocyanine blue: KET BLUE 111 produced by DIC Corporation) were mixed using an FM mixer (product of Nippon Coke & Engineering Co., Ltd.) at a rotational speed of 2,400 rpm. The resultant mixture was melt-kneaded using a twin-screw extruder (PCM-30 produced by Ikegai Corp.) under conditions of a material input rate of 5 kg/hour, a shaft rotational speed of 160 rpm, and a temperature setting range of 100° C. to 130°

C. The resultant kneaded product was cooled and then coarsely pulverized using a pulverizer (Rotoplex (registered Japanese trademark) produced by Hosokawa Micron Corporation). The resultant coarsely pulverized product was finely pulverized using a jet mill (Model-I Supersonic Jet Mill produced by Nippon Pneumatic Mfg. Co., Ltd.). The resultant finely pulverized product was classified using a classifier (Elbow Jet Type EJ-LABO produced by Nittetsu Mining Co., Ltd.). As a result, toner cores were obtained.

(Shell Layer Formation Process)

First, 300 mL of ion exchanged water was added into a three-necked flask equipped with a thermometer and a stirring impeller, and having a capacity of 1 L. Thereafter, a temperature inside the flask was maintained at 30° C. using a water bath. Next, dilute hydrochloric acid was added into the flask to adjust a pH of the aqueous medium within the flask to 4. After pH adjustment, 0.35 mL of an aqueous solution of a hexamethylol melamine prepolymer (MIRBANE (registered Japanese trademark) RESIN SM-607 produced by Showa Denko K.K., solid concentration: 80% by mass) and 150 mL of the suspension of the thermoplastic resin fine particles I were added into the flask as raw materials for the shell layer. The raw materials for the shell layer (in particular hexamethylol melamine) were dissolved in the aqueous medium to prepare an aqueous solution (A) of the raw materials for the shell layer. Then, 300 g of the toner cores were added to the aqueous solution (A), and the flask contents were stirred for 1 hour at a rotational speed of 200 rpm. Then, 300 mL of ion exchanged water was added into the flask. Thereafter, a temperature inside the flask was increased to 70° C. at a rate of 1° C./minute while stirring the flask contents at a rotational speed of 100 rpm. Once the temperature inside the flask reached 70° C., the flask contents were stirred for further 2 hours under conditions of the temperature of 70° C. and a rotational speed of 100 rpm. Thereafter, sodium hydroxide was added into the flask to adjust a pH of the flask contents to 7. Then, the flask contents were cooled to normal temperature (approximately 25° C.) to yield a toner mother particle-containing dispersion.

(Washing Process)

A wet cake of toner mother particles was collected from the toner mother particle-containing dispersion using a Buchner funnel. Subsequently, the wet cake of the toner mother particles was redispersed in ion exchanged water to wash the toner mother particles. The toner mother particles were washed five times with ion exchanged water as described above.

(Drying Process)

A slurry was prepared by dispersing the wet cake of the toner mother particles obtained through the washing process in 50% by mass concentration aqueous ethanol solution. The prepared slurry was fed into a continuous type surface modifier (Coatmizer (registered Japanese trademark) produced by Freund Corporation) to dry the toner mother particles in the slurry and yield dry toner mother particles. Drying was carried out at a hot air temperature of 45° C. and a blower flow rate of 2 $m^3$/minute.

(External Addition Process)

First, 100 parts by mass of the toner mother particles obtained through the drying process and 1.0 part by mass of dry silica (AEROSIL(registered Japanese trademark) REA90 produced by Nippon Aerosil Co., Ltd.) were mixed for 5 minutes using an FM mixer (product of Nippon Coke & Engineering Co., Ltd.) having a capacity of 10 L to cause the external additive to adhere to the surface of each toner mother particle. Thereafter, the resultant toner was sifted using a 200 mesh sieve (opening: 75 μm) to yield a toner of Example 1.

Example 2

A toner of Example 2 was produced in the same manner as the toner of Example 1 except that the suspension of the thermoplastic resin fine particles II was used instead of the suspension of the thermoplastic resin fine particles I in the shell layer formation process.

Example 3

A toner of Example 3 was produced in the same manner as the toner of Example 1 except that the suspension of the thermoplastic resin fine particles III was used instead of the suspension of the thermoplastic resin fine particles I in the shell layer formation process.

Example 4

A toner of Example 4 was produced in the same manner as the toner of Example 1 except that the amount of the aqueous solution of the hexamethylol melamine prepolymer was changed from 0.35 mL to 0.6 mL in the shell layer formation process.

Example 5

A toner of Example 5 was produced in the same manner as the toner of Example 1 except that the amount of the aqueous solution of the hexamethylol melamine prepolymer was changed from 0.35 mL to 0.1 mL in the shell layer formation process.

Example 6

A toner of Example 6 was produced in the same manner as the toner of Example 1 except that the amount of the suspension of the thermoplastic resin fine particles I was changed from 150 mL to 300 mL in the shell layer formation process.

Example 7

A toner of Example 7 was produced in the same manner as the toner of Example 1 except that the amount of the suspension of the thermoplastic resin fine particles I was changed from 150 mL to 100 mL in the shell layer formation process.

Comparative Example 1

A toner of Comparative Example 1 was produced in the same manner as the toner of Example 1 except that 27 mL of a suspension of hydrophilic thermoplastic resin fine particles IV (BECKAMINE (registered Japanese trademark) A-1 produced by DIC Corporation, component: water-soluble polyacrylamide, solid concentration: 11%) was used instead of 150 mL of the thermoplastic resin fine particles I in the shell layer formation process.

Comparative Example 2

A toner of Comparative Example 2 was produced in the same manner as the toner of Example 1 except that the amount of the aqueous solution of the hexamethylol melamine prepolymer was changed from 0.35 mL to 1.2 mL in the shell layer formation process.

Comparative Example 3

A toner of Comparative Example 3 was produced in the same manner as the toner of Example 1 except that the aqueous solution of the hexamethylol melamine prepolymer was not used in the shell layer formation process.

[Evaluation Methods]

The following describes methods for evaluating each sample (each of the toners of Examples 1 to 7 and Comparative Examples 1 to 3).

(Cross-Sectional Observation by EELS)

A cold-setting epoxy resin in which a sample (toner) had been dispersed was left to harden at an ambient temperature of 40° C. for 2 days to yield a hardened material. The resultant hardened material was dyed using osmium tetroxide and subsequently a flake sample of 200 nm in thickness was cut therefrom using an ultramicrotome (EM UC6 produced by Leica Microsystems) equipped with a diamond knife. A photograph of a cross section of the sample was taken using a field emission transmission electron microscope (TEM) (JEM-2100F produced by JEOL Ltd.) at an accelerating voltage of 200 kV. A nitrogen-atom distribution image was obtained by analyzing the TEM photograph using an electron energy loss spectroscopy (EELS) detector (GIF TRIDIEM (registered Japanese trademark) produced by Gatan, Inc.) having an energy resolution of 1.0 eV and a beam diameter of 1.0 nm and image analysis software (WinROOF 5.5.0 produced by Mitani Corporation).

(High-Temperature Preservability)

First, 2 g of a sample (toner) was put into a polyethylene container having a capacity of 20 mL and the container was left in a thermostatic chamber set to 60° C. for 3 hours. Thereafter, the container was taken out of the thermostatic chamber and cooled to prepare an evaluation toner. The evaluation toner was placed on a 100 mesh sieve (opening: 150 μm) of a known mass. A mass of the sieve containing the evaluation toner was measured to determine a mass of the toner before shifting. Then, the sieve was set in a powder tester (product of Hosokawa Micron Corporation) and caused to vibrate in accordance with a manual of the powder tester at a rheostat level of 5 for 30 seconds in order to sift the evaluation toner. After shifting, a mass of the toner that did not pass through the sieve (toner remaining on the sieve) was measured. A degree of aggregation (unit: % by mass) was calculated from the mass of the toner before shifting and the mass of the toner after shifting (mass of the toner that did not pass through the sieve) based on the following equation.

$$\text{Degree of aggregation}=100\times(\text{mass of toner after sifting})/(\text{mass of toner before sifting})$$

High-temperature preservability of the sample (toner) was evaluated based on the calculated degree of aggregation according to the following criteria.

- ○ (Good): Degree of aggregation of no greater than 50% by mass
- x (Bad): Degree of aggregation of greater than 50% by mass (Charge Decay Constant)

A charge decay constant α of a toner before external addition (charge decay constant of toner mother particles) was measured using an electrostatic diffusivity measuring device (NS-D100 produced by Nano Seeds Corporation) by a method in accordance with a Japanese Industrial Standard (JIS C 61340-2-1). The following describes the method for measuring the charge decay constant of the toner in detail.

A sample (toner before external addition) was placed in a measurement cell. The measurement cell was a metal cell with a recess having an inner diameter of 10 mm and a depth of 1 mm. The sample was thrust from above using a glass slide to fill the recess of the cell with the sample. A portion of the sample brimming over the cell was removed by reciprocating the glass slide on a surface of the cell. The cell was filled with at least 0.04 g and no greater than 0.06 g of the sample.

Subsequently, the measurement cell filled with the sample was left in an environment at a temperature of 32° C. and a relative humidity of 80% for 12 hours. Thereafter, the measurement cell was grounded and placed in the electrostatic diffusivity measuring device. Ions were then supplied to the sample through corona discharge to charge the sample for 0.5 seconds. After elapse of 0.7 seconds from completion of the corona discharge, a surface potential of the sample was measured continuously. A charge decay constant (charge decay rate) α was calculated based on the measured surface potential and an equation: $V=V_0\exp(-\alpha\sqrt{t})$. In the equation, V represents a surface potential [V], $V_0$ represents an initial surface potential [V], and t represents a decay period [second].

A charge decay constant measured for each sample (toner) was evaluated according to the following criteria.

- ○ (Good): Charge decay constant of no greater than 0.100
- x (Bad): Charge decay constant of greater than 0.100

(Preparation of Evaluation Developer)

Low-temperature fixability, transfer efficiency, and drum adhesion of each sample (toner) was evaluated using a two-component developer prepared as described below.

An evaluation developer (two-component developer) was prepared by mixing a developer carrier (carrier for TASKalfa5550ci produced by KYOCERA Document Solutions Inc.) and 10% by mass of a toner relative to a mass of the carrier for 30 minutes using a ball mill.

(Low-Temperature Fixability)

A color printer (FS-C5250DN produced by KYOCERA Document Solutions Inc., modified so as to be capable of changing a fixing temperature) equipped with a roller-roller type heat and pressure fixing device (nip width: 8 mm) was used as an evaluation apparatus. The evaluation developer (two-component developer) prepared as described above was loaded into a developing device of the evaluation apparatus, and the sample (toner for replenishment use) was loaded into a toner container of the evaluation apparatus.

In order to evaluate fixability of the sample (toner), a solid image having a size of 25 mm×25 mm and a coverage of 100% was formed on paper having a basis weight of 90 g/m$^2$ (printing paper of A4 size) using the evaluation apparatus under conditions of a linear speed of 200 mm/second (nip passage time: 40 milliseconds) and a toner application amount of 1.0 mg/cm$^2$. Next, the paper having the image formed thereon was passed through the fixing device. A fixing temperature was set within a range of 100° C. to 200° C. Specifically, a lowest temperature at which the toner (solid image) could be fixed to the paper (lowest fixing temperature) was measured by gradually increasing the fixing temperature of the fixing device from 100° C.

In measurement of the lowest fixing temperature, whether or not the toner could be fixed was checked by a fold-rubbing test described below. Specifically, the paper was folded in half such that a surface on which the image was formed was folded inward, and a 1-kg weight covered with cloth was rubbed back and forth on the fold ten times. Then, the paper was unfolded to observe the folded portion of the paper (portion on which the solid image was formed). A length of peeling of the toner (peeling length) in the folded portion was measured. The lowest fixing temperature was determined to be a lowest temperature among fixing temperatures for which the peeling length was less than 1 mm. Low-temperature fixability of the sample (toner) was evaluated based on the measured lowest fixing temperature according to the following criteria.

○ (Good): Lowest fixing temperature of no greater than 160° C.

x (Bad): Lowest fixing temperature of greater than 160° C.

(Transfer Efficiency and Resistance to Drum Adhesion)

In evaluation of the transfer efficiency, a color multifunction peripheral (TASKalfa 5550ci produced by KYOCERA Document Solutions Inc.) was used as an evaluation apparatus. The evaluation developer (two-component developer) prepared as described above was loaded into a developing device of the evaluation apparatus, and the sample (toner for replenishment use) was loaded into a toner container of the evaluation apparatus. Continuous printing of an image having a coverage of 5% was performed on 10,000 sheets of a recording medium (printing paper of A4 size) in an environment at a temperature of 32° C. and a relative humidity of 80% while replenishing the sample (toner). During the continuous printing, whether or not a surface of a photosensitive drum was stained with the toner was visually observed periodically. Also, a mass of consumed toner and a mass of collected toner were measured after the continuous printing, and the transfer efficiency (unit: %) was calculated based on the following equation.

Transfer efficiency=100×((mass of consumed toner)−(mass of collected toner))/(mass of consumed toner)

The consumed toner refers to a portion of the sample (toner) loaded into the toner container and discharged from the toner container. The collected toner refers to a portion of the consumed toner that was not transferred to the recording medium.

The transfer efficiency measured for each sample (toner) was evaluated according to the following criteria.

○ (Good): Transfer efficiency of at least 80% x (Bad): Transfer efficiency of less than 80%

[Evaluation Results]

The following describes evaluation results of the samples (the toners of Examples 1 to 7 and Comparative Examples 1 to 3).

Figure 8:
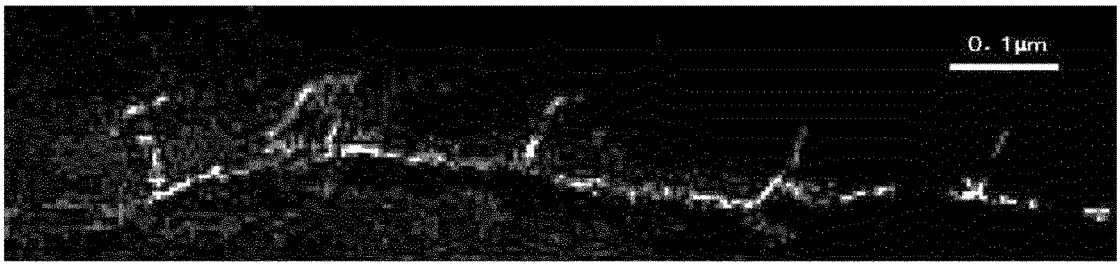
FIG. 8 is a photograph of a cross section of a toner particle in a toner according to an example of the present invention, which photograph was taken using a field emission transmission electron microscope.
Figure 9:
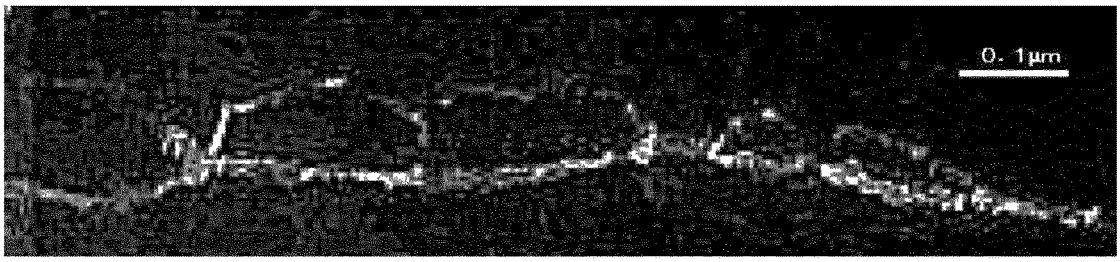
FIG. 9 is a photograph of a cross section of a toner particle in a toner according to a comparative example, which photograph was taken using a field emission transmission electron microscope.

FIGS. 8 and 9 show evaluation results of the cross-sectional observation by EELS. Whether or not a hydrophobic thermoplastic resin was exposed at a surface of a toner particle included in each sample (toner) will be described with reference to FIGS. 8 and 9. FIG. 8 is a photograph of a cross section of a toner particle included in the toner of Example 1, which photograph was taken using a field emission transmission electron microscope (TEM) (JEM-2100F produced by JEOL Ltd.). FIG. 9 is a photograph of a cross section of a toner particle included in the toner of Comparative Example 2, which photograph was taken using the field emission transmission electron microscope (TEM) (JEM-2100F produced by JEOL Ltd.).

As shown in FIG. 8, a hydrophilic thermosetting resin (melamine resin) containing a large number of nitrogen atoms was distributed in a manner to cover a surface of the toner particle included in the toner of Example 1. Further, the hydrophilic thermosetting resin formed protrusions. A hydrophobic thermoplastic resin was distributed in a manner to fill spaces between the protrusions. The hydrophobic thermoplastic resin was exposed at the surface of the toner particle. Toner particles included in the toners of Examples 2 to 7 each had a structure similar to that of the toner particle included in the toner of Example 1.

In the toner of Comparative Example 2, a hydrophobic thermoplastic resin was not exposed at a surface of the toner particle, as illustrated in FIG. 9. Specifically, a hydrophilic thermosetting resin (melamine resin) containing a large number of nitrogen atoms was distributed in a manner to cover a toner core of the toner particle included in the toner of Comparative Example 2. However, a junction portion formed from the hydrophilic thermosetting resin covered blocks of the hydrophobic thermoplastic resin. Therefore, at the surface of the toner particle, the hydrophilic thermosetting resin was exposed and the blocks of the hydrophobic thermoplastic resin were not exposed.

Table 2 indicates evaluation results of high-temperature preservability, low-temperature fixability, charge decay constant, drum adhesion, and transfer efficiency of the toners of Examples 1 to 7 and Comparative Examples 1 to 3.

TABLE 2

| | High-temperature preservability [% by mass] | Low-temperature fixability [° C.] | Charge decay | Drum adhesion | Transfer efficiency [%] |
|---|---|---|---|---|---|
| Example 1 | 20 | 149 | 0.011 | Absent | 92 |
| Example 2 | 43 | 143 | 0.013 | Absent | 90 |
| Example 3 | 12 | 155 | 0.008 | Absent | 95 |
| Example 4 | 8 | 157 | 0.012 | Absent | 92 |
| Example 5 | 48 | 145 | 0.010 | Absent | 93 |
| Example 6 | 18 | 156 | 0.011 | Absent | 94 |
| Example 7 | 32 | 146 | 0.010 | Absent | 90 |
| Comparative example 1 | 42 | 140 | 0.340 (x) | Absent | 43 (x) |
| Comparative example 2 | 9 | 176 (x) | 0.139 (x) | Absent | 67 (x) |
| Comparative example 3 | 43 | 153 | 0.008 | Present (200 sheets) | — |

The toners of Examples 1 to 7 were electrostatic latent image developing toners having the above-described features (1) and (2). Specifically, the toners of Examples 1 to 7 each included toner particles each including a toner core and a shell layer covering a surface of the toner core. The shell layer contained a hydrophilic thermosetting resin and a hydrophobic thermoplastic resin. The hydrophobic thermoplastic resin was exposed at a surface of each toner particle.

The toners of Examples 1 to 7 were each evaluated as good in high-temperature preservability, low-temperature fixability, charge decay constant, drum adhesion, and transfer efficiency. Transfer efficiency of the toner of Comparative Example 3 could not be measured since drum adhesion occurred when printing was performed on 200 sheets.

It should be noted that when a small amount of a monomer that has an alcoholic hydroxyl group (for example, 2-hydroxyethyl methacrylate) was used in addition to styrene and butyl acrylate to prepare the thermoplastic resin fine particles I in production of the toner of Example 1, the shell layer contained a hydrophobic thermoplastic resin including a repeating unit that has the alcoholic hydroxyl group. In this case too, good results (○) were achieved in all the evaluations. Further, film quality of the shell layer was improved by introduction of the repeating unit having the alcoholic hydroxyl group into the hydrophobic thermoplastic resin forming the shell layer.

INDUSTRIAL APPLICABILITY

The electrostatic latent image developing toner according to the present invention can be used for image formation for example in a multifunction peripheral, a copier, or a printer.

The invention claimed is:

1. An electrostatic latent image developing toner comprising:

toner particles each including a toner core and a shell layer covering a surface of the toner core, wherein:

the shell layer contains a hydrophilic thermosetting resin and a hydrophobic thermoplastic resin, the hydrophobic thermoplastic resin is exposed at surfaces of the toner particles, and in the shell layer, a plurality of blocks substantially formed from the hydrophobic thermoplastic resin are connected to one another through a junction portion substantially formed from the hydrophilic thermosetting resin.

2. The electrostatic latent image developing toner according to claim 1, wherein the hydrophilic thermosetting resin includes one or more resins selected from the group consisting of melamine resins, urea resins, and glyoxal resins.

3. The electrostatic latent image developing toner according to claim 1, wherein the hydrophobic thermoplastic resin includes a repeating unit that has an alcoholic hydroxyl group.

4. The electrostatic latent image developing toner according to claim 3, wherein the repeating unit that has the alcoholic hydroxyl group originates from a (meth)acrylic acid 2-hydroxyalkyl ester.

5. The electrostatic latent image developing toner according to claim 4, wherein the (meth)acrylic acid 2-hydroxyalkyl ester is 2-hydroxyethyl acrylate, 2-hydroxypropyl acrylate, 2-hydroxyethyl methacrylate, or 2-hydroxypropyl methacrylate.

6. The electrostatic latent image developing toner according to claim 2, wherein the hydrophobic thermoplastic resin is a styrene-butyl acrylate copolymer, a urethane resin, a polyester resin, or an ethylene-vinyl alcohol copolymer.

7. The electrostatic latent image developing toner according to claim 1, wherein the hydrophilic thermosetting resin is a melamine resin, and the hydrophobic thermoplastic resin is a polymer of styrene and butyl acrylate.

* * * * *